US007383872B1

(12) United States Patent
Jellá

(10) Patent No.: US 7,383,872 B1
(45) Date of Patent: Jun. 10, 2008

(54) TRIM BOARD ASSEMBLY AND DOOR SECTION FOR CARRIAGE HOUSE REPLICA GARAGE DOOR

(75) Inventor: John F. Jellá, Tempe, AZ (US)

(73) Assignee: First United Door Technologies, LLC, Tempe, AZ (US)

( * ) Notice: Subject to any disclaimer, the term of this patent is extended or adjusted under 35 U.S.C. 154(b) by 328 days.

(21) Appl. No.: 10/965,471

(22) Filed: Oct. 13, 2004

Related U.S. Application Data

(63) Continuation-in-part of application No. 10/413,989, filed on Apr. 14, 2003, now abandoned, which is a continuation-in-part of application No. 09/792,543, filed on Feb. 22, 2001, now abandoned.

(51) Int. Cl.
*E06B 3/12* (2006.01)

(52) U.S. Cl. ..... 160/236; 428/76; 52/717.01

(58) Field of Classification Search ..... 160/201, 160/236; 52/716.6, 716.8, 717.01, 718.02, 52/718.01, 718.04, 718.06, 718.03, 716.5, 52/716.1, 717.06, 309.9, 784.1, 784.13, 784.15; 428/621, 76
See application file for complete search history.

(56) References Cited

U.S. PATENT DOCUMENTS

| | | | | |
|---|---|---|---|---|
| 2,297,887 | A | 10/1942 | Hall et al. | |
| 4,284,119 | A | 8/1981 | Martin et al. | |
| 4,416,100 | A | 11/1983 | Troendle, Sr. | |
| 4,589,240 | A * | 5/1986 | Kendall et al. | 52/309.11 |
| 4,709,525 | A * | 12/1987 | Adell | 52/716.6 |
| 5,016,700 | A | 5/1991 | Wegner et al. | |
| 5,509,457 | A | 4/1996 | Jella | |
| 5,553,422 | A * | 9/1996 | Gazaway | 52/204.53 |
| 5,598,667 | A * | 2/1997 | Dykes | 52/71 |
| 5,626,176 | A | 5/1997 | Lewis et al. | |
| 5,673,523 | A * | 10/1997 | Greenberg | 52/300 |
| 5,737,802 | A | 4/1998 | Jella | |
| 5,839,252 | A | 11/1998 | Berghorn et al. | |
| 6,112,481 | A | 9/2000 | Schiedegger et al. | |
| 6,148,896 | A | 11/2000 | Pinto et al. | |
| 6,311,454 | B1 | 11/2001 | Kempel | |
| 6,381,917 | B1 * | 5/2002 | Thielow et al. | 52/784.1 |

(Continued)

FOREIGN PATENT DOCUMENTS

JP 2005-254717 * 3/2004

OTHER PUBLICATIONS

U.S. Appl. No. 60/193,711, Buhrts et al.

*Primary Examiner*—Blair M. Johnson
(74) *Attorney, Agent, or Firm*—Michael A. Mann; Nexsen Pruet, LLC

(57) ABSTRACT

A carriage house replica garage door (20) is formed from first, second, and third door sections (22, 24, 26). Each of the door sections (22, 24, 26) includes a sheet metal layer (30). A trim board assembly (232) includes a backing (234) configured for attachment to the sheet metal layer (30) and a channel section (236) installed over the backing (234). Brace means in the form of insulating foam board (238) is juxtaposed between the backing (234) and the channel section (236). The insulating foam board (238) is adhered between the backing (34) and the channel section (236) so that physical contact is inhibited between the backing (234) and the channel section (236) at an attachment location.

18 Claims, 9 Drawing Sheets

U.S. PATENT DOCUMENTS 6,412,247 B1 * 7/2002 Menchetti et al. ..... 52/731.1
6,446,695 B1 9/2002 Forsland
6,586,085 B1 7/2003 Jella
6,662,515 B2 12/2003 Buhrts et al.
6,772,818 B2 * 8/2004 Whitley et al. ..... 160/236
6,945,001 B1 * 9/2005 Suzuki ..... 52/582.1

* cited by examiner

TRIM BOARD ASSEMBLY AND DOOR SECTION FOR CARRIAGE HOUSE REPLICA GARAGE DOOR

RELATED INVENTION

The present invention is a continuation-in-part (CIP) of "TRIM BOARD SYSTEM AND DOOR SECTION FOR CARRIAGE HOUSE REPLICA GARAGE DOOR," U.S. patent application Ser. No. 10/413,989, filed 14 Apr. 2003, now abandoned, which is a continuation-in-part (CIP) of "DOOR SECTION FOR CARRIAGE HOUSE REPLICA GARAGE DOOR," U.S. patent application Ser. No. 09/792,543, filed 22 Feb. 2001, abandoned, both of which are incorporated by reference herein.

TECHNICAL FIELD OF THE INVENTION

The present invention relates to the field of garage doors. More specifically, the present invention relates to garage doors that replicate wood sectional carriage house garage doors.

BACKGROUND OF THE INVENTION

A typical overhead garage door is constructed from a plurality of door sections, which are hinged together and supported from a track system with rollers attached to opposite ends of the door sections. The rollers generally allow the door to be moved from a vertically oriented closed position to a substantially horizontal open position. Electrically powered garage door openers are often used with the overhead garage door so that a driver may conveniently open and close the door from within a vehicle.

With regard to residential applications, an overhead garage door is generally either eight or sixteen feet wide. Typically, such a door includes four horizontally oriented door sections, each of which is about eight or sixteen feet wide and twenty-one inches high. For example, a single car residential garage may have an eight foot wide by seven foot high door. Likewise, a two car residential garage may have a single sixteen foot wide door by seven foot high door or two eight foot wide by seven foot high doors.

Some of the first doors made for garages were one piece barn doors that operated as large swinging or sliding doors. The nostalgic design of these doors is replicated in wood sectional carriage house garage doors. Indeed, wood sectional carriage house garage doors are particularly desirable for use with older homes to maintain the historic design of the home while gaining the convenience of the conventional overhead garage door. Carriage house garage doors are also desirable with newer homes for enhancing the overall appearance of the garage and consequently the house.

A sectional carriage house door functions like a typical overhead garage door in that it moves on a track and roller system to open and close the door. However, the appearance of the sectional carriage house door simulates the historic swing type doors used in early automobile shelters. The historic appearance of the sectional carriage house door is created by the application of various types of wood siding, wood trim boards, and/or wood raised panels applied over the exterior side of wood flush door sections, and wood or steel open frame door sections.

Unfortunately, a wood carriage house garage door is very costly relative to a conventional steel overhead garage door. This cost is due in part to labor costs incurred to perform the largely manual process of constructing the wood carriage house door. Furthermore, the material cost for the wood siding, wood trim boards, and/or wood raised panels is undesirably high. Thus, a homeowner may pay five to six times more for a wood carriage house door than for a conventional steel overhead door.

In addition to the costly initial investment, wood carriage house doors are costly to maintain. In particular, the wood is adversely affected by the elements. That is sun, rain, snow, varying temperatures, and so forth will degrade the finish of the wood and eventually cause the wood to warp, split, or rot. Consequently, the wood carriage house garage door should be re-sealed or re-painted every couple of years to maintain the aesthetic appearance and integrity of the wood carriage house garage door. This labor intensive and costly maintenance is highly undesirable to the typical homeowner.

In addition, insects, such as termites and carpenter ants, frequently attack the wood causing significant damage to the wood. Accordingly, the use of a wood carriage house garage door necessitates frequent inspections and treatment for insect damage. Again, this is a highly undesirable situation to the homeowner in terms of labor and cost.

Another problem with a wood carriage house garage door results from the weight of the wood siding, wood trim board, and/or wood raised panels, which typically adds one hundred to two hundred pounds to the overall weight of the sectional carriage house door. In particular, the wood or steel open frame door sections often lack the structural integrity or the strength to adequately support the added weight of the wood siding. Thus, the wood carriage house door has a limited life.

In addition, the wood carriage house door necessitates the use of reinforced hardware to support the weight of the wood. This leads to higher up front costs incurred by the homeowner for the appropriate hardware. If hardware is used that is insufficient for supporting the door, the door may repeatedly fall out of the door tracks, or the hardware components, such as the rollers, connection points, springs, or the tracks could fail causing property damage and/or injury.

In addition to the excessive cost and mechanical problems associated with a wood sectional carriage house door, the sectional carriage house door suffers from problems associated with aesthetic appearance. In particular, the use of four twenty-one inch horizontally oriented door sections to form the carriage house door results in three horizontal lines created at the section joints. These horizontal lines at the section joints detract from the appearance of the door, which is contrary to the objectives of maintaining the historic design and enhancing the overall appearance of the garage.

Thus, what is needed is an overhead garage door that is affordable, durable, low maintenance, impervious to weather and insects, and replicates the appearance of the historic swing type doors used in early automobile shelters.

SUMMARY OF THE INVENTION

Accordingly, it is an advantage of the present invention that a door section for a carriage house replica garage door is provided.

It is another advantage of the present invention that a door section is provided to form an aesthetically pleasing and cost effective replica of a wood sectional carriage house garage door.

It is another advantage of the present invention that a door section is provided to form a carriage house replica garage door that is relatively lightweight and structurally sound.

Yet another advantage of the present invention is that a trim board assembly is provided for a door section of a carriage house replica garage door that is durable in extreme environmental conditions and requires little maintenance.

The above and other advantages of the present invention are carried out in one form by a trim board assembly for a door section of a carriage house replica garage door. The trim board assembly includes a backing configured for attachment to a face of the door section, a channel section installed over the backing, and means for attaching the channel section to the backing that prevents physical contact between the backing and the channel section at an attachment location.

The above and other advantages of the present invention are carried out in another form by a door section for a carriage house replica garage door. The door section includes a sheet metal layer having an outer face and a trim board assembly. The trim board assembly includes a backing attached to said face of said door section, a channel section installed over the backing, and brace means juxtaposed between the backing and the channel section. Each of the backing and the channel section is formed from sheet metal. The trim board assembly further includes means for attaching the channel section to the backing that prevents physical contact between the backing and the channel section at an attachment location.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
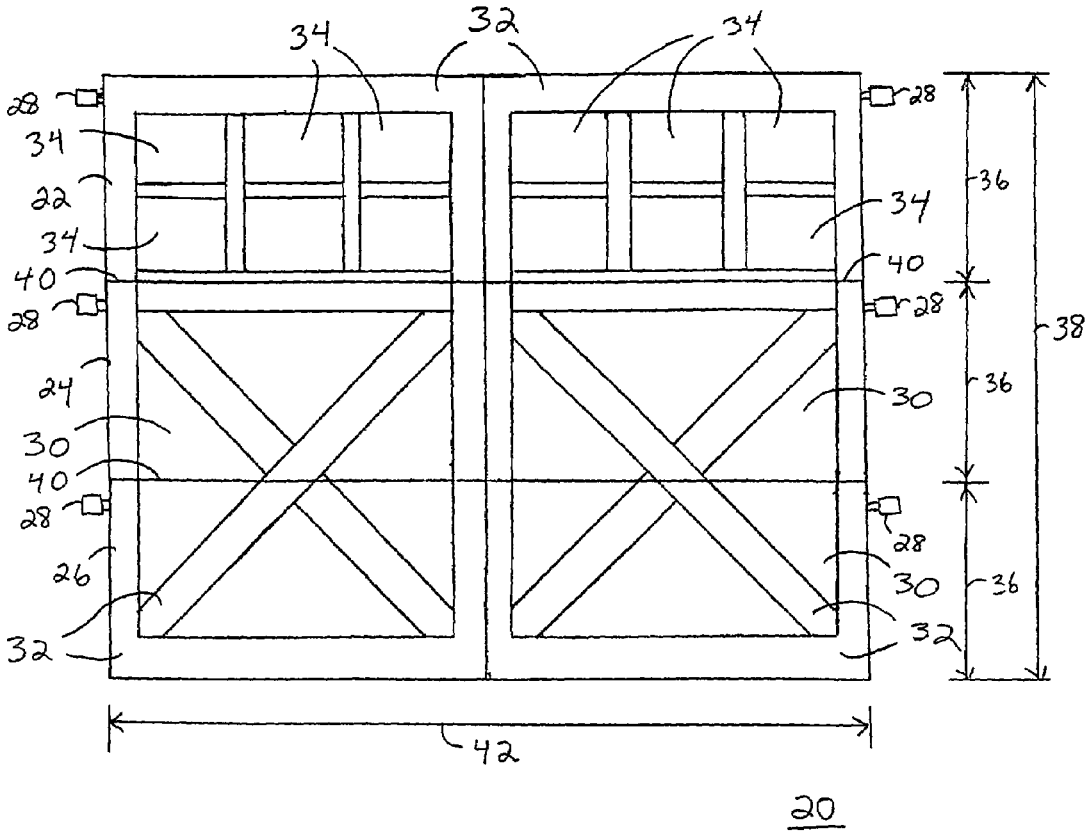
FIG. 1 shows a front view of a carriage house replica garage door in accordance with a preferred embodiment of the present invention.

FIG. 1 shows a front view of a carriage house replica garage door 20 in accordance with a preferred embodiment of the present invention. Carriage house replica garage door 20 replicates in appearance a conventional wood sectional carriage house garage door, hence the use of the term "replica" in carriage house replica garage door 20. Carriage house replica garage door 20 is an overhead sectional garage door having first, second, and third door sections 22, 24, and 26, respectively, that are hinged together.

Guide members 28, attached to opposite ends of each of first, second, and third door sections 22, 24, and 26, allow door 20 to be moved from a vertically oriented closed position to a substantially horizontal open position along a track system (not shown) coupled to a garage (not shown). One exemplary track system including guide members 28 is described in "Door Track", by John F. Jellá, U.S. Pat. No. 5,737,802, issued 14 Apr. 1998, and incorporated by reference herein.

Carriage house replica garage door 20 simulates the appearance of historic swing type doors used in early automobile shelters. However, carriage house replica garage door 20 utilizes materials that are lightweight, resistant to the effects of weather and insects, and low maintenance. For example, carriage house replica garage door 20 includes a sheet metal layer 30 with cellular foam trim boards 32 attached to and arranged in a pattern over sheet metal layer 30. First door section 22 of door 20 also includes windows 34 to further enhance the aesthetic appearance of door 20.

The pattern of cellular foam trim boards 32 over sheet metal layer 30, known as a cross-buck pattern, and the inclusion of windows 34 in carriage house replica garage door 20 represents one configuration of carriage house replica garage door 20. However, it should be apparent to those skilled in the art, that cellular foam trim boards 32 and/or windows 34 may be arranged differently then what is shown in FIG. 1 to obtain a desired style for carriage house replica garage door 20. For example, cellular foam trim boards 32 may be arranged in a half-buck pattern, perimeter pattern, vertical pattern, horizontal pattern, and so forth, while windows 34 may be smaller, larger, include curve tops, and so forth.

In a preferred embodiment, carriage house replica garage door 20 is manufactured from three door sections, i.e., first, second, and third door sections 22, 24, and 26, each having a height 36 of substantially twenty-eight inches. Thus, first, second, and third door sections 22, 24, and 26 function cooperatively to yield an overall height 38 of substantially eight-four inches, or seven feet.

A total of three door sections advantageously decreases a number section joints from three, created by the four sections of conventional overhead doors, to only two section joints 40 created by the three wood overlay sections 22, 24, and 26 of garage door 20. The two section joints 40 of garage door 20 are less conspicuous than the three section joints of a wood carriage house garage door or conventional overhead garage door thereby effectively enhancing the appearance of carriage house replica garage door over conventional sectional garage doors.

In the illustrative embodiment of FIG. 1, each of first, second, and third door sections 22, 24, and 26, respectively, has a width 42 of approximately ninety-six inches, or eight feet. Thus, garage door 20 is sized to fit a conventional single-car residential garage door opening of eight feet wide by seven feet high. Alternatively, garage door 20 may be adapted to fit a two car residential garage having a single sixteen foot wide by seven foot high opening, or another conventional or custom dimensioned garage door opening.

Figure 2:
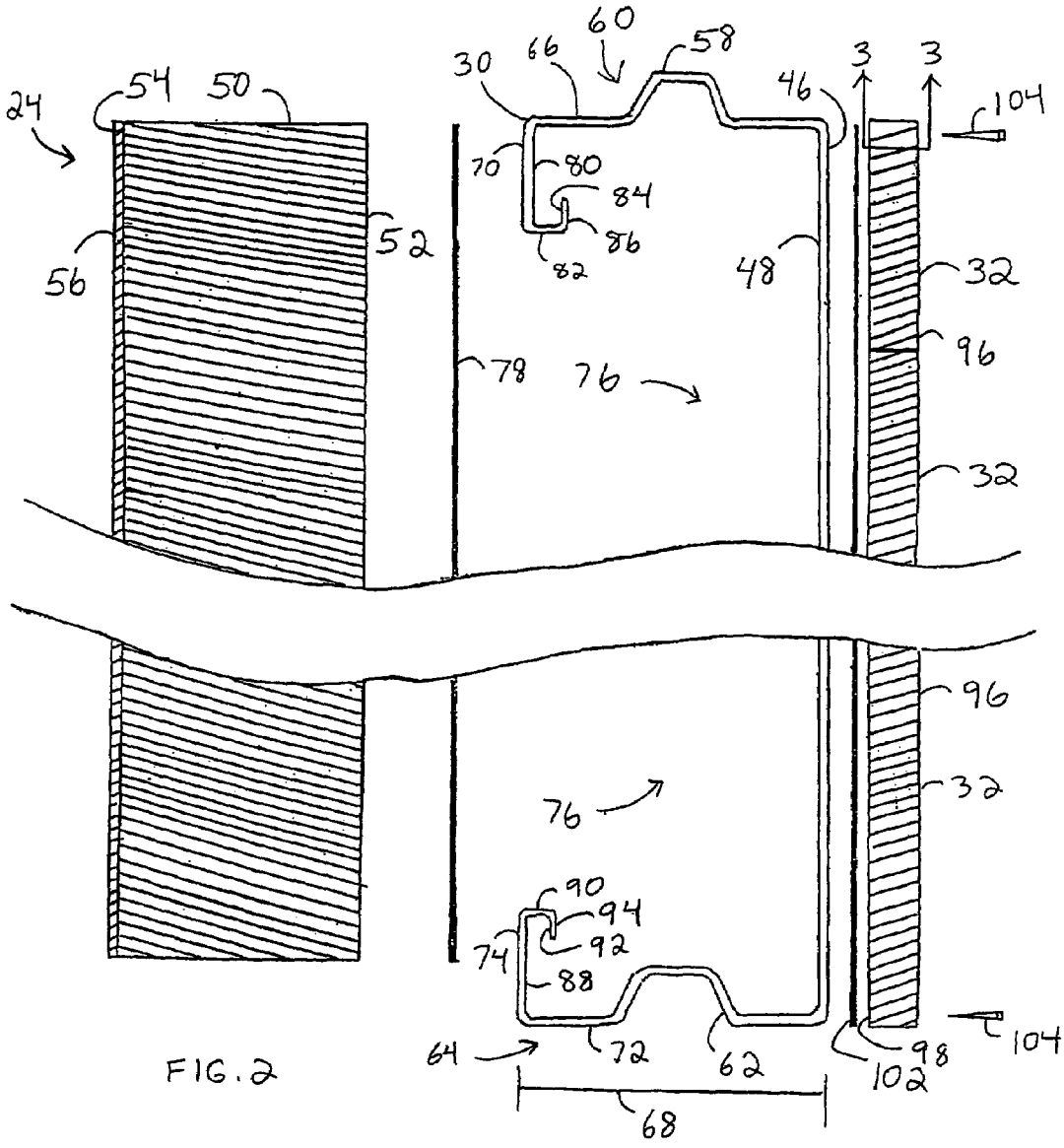
FIG. 2 shows a partial, exploded side view of a door section of the carriage house replica garage door of FIG. 1.

FIG. 2 shows a partial, exploded side view of second door section 24 of carriage house replica garage door 20 (FIG. 1). The structure of second door section 24 is described for clarity of illustration. However, it should be understood that first and third door sections 22 and 26, respectively, are fabricated in a similar manner. The differences between first, second, and third door sections 22, 24, and 26 are the absence or presence of windows 34 (FIG. 1) and/or the pattern of cellular foam trim boards 32. Consequently, the following description of the structure of second door section 24 applies to first and third door sections 22 and 26 as well.

Second door section 24 includes sheet metal layer 30 having an outer surface 46 and an inner surface 48. Sheet metal layer 30 is rotary embossed with a wood grain pattern to replicate an appearance of wood on outer surface 46. An insulating foam board 50 has a first side 52 coupled to inner surface 48 of sheet metal layer 30 and a second side 54 having a steel laminate backing 56. Cellular foam trim boards 32 are coupled to outer surface 46 of sheet metal layer 30. In a preferred embodiment, sheet metal layer 30 is formed from twenty-four gauge steel. Although twenty-four gauge steel is preferred, it should be apparent to those skilled in the art that other widths of steel may be utilized. Alternatively, other metals, such as aluminum, formed into sheets may be utilized.

Sheet metal layer 30 includes a tongue portion 58 along a first longitudinal edge 60 and a groove portion 62 located along a second longitudinal edge 64 of sheet metal layer 30. Following, rotary embossment of sheet metal layer 30 with a wood grain pattern, tongue and groove portions 58 and 62, respectively, are fabricated on sheet metal layer 30 by roll forming. Roll forming is a progressive process in which sheet metal layer 30 is shaped by a series of rolls, each roll slightly changing the shape of the sheet metal. When the sheet metal reaches the end of the line, the desired shape is achieved. Roll forming produces high quality products quickly and inexpensively compared to traditional press operations and is desirable for producing long shapes.

The roll forming of sheet metal layer 30 produces tongue portion 58 having a tongue surface 66 spanning a width 68 of sheet metal layer 30 and a first rear support section 70 contiguous with tongue surface 66. Likewise, the roll forming of sheet metal layer 30 produces groove portion 62 having a groove surface 72 that spans width 68 of sheet metal layer 30 and a second rear support section 74 contiguous with groove surface 72. As such, a cavity 76 is formed in second door section 24.

Insulating foam board 50 is positioned in cavity 76 and first side 52 is bonded to inner surface 48 of sheet metal layer 30 using an adhesive 78. In an exemplary embodiment, adhesive 78 is a hot melt polyurethane reactive (PUR) adhesive. Hot melt PUR adhesive is preferred because it may be applied to a substrate as a dot or as a thin glue line, rather than using a slot die or roll coater. In addition, hot melt PUR adhesive sets in seconds and is structurally rigid in minutes following a final set. Although hot melt PUR adhesive is preferred, it should be apparent to those skilled in the art, that other adhesives may be used in place of hot melt PUR adhesive that have these similar properties.

Insulating foam board 50 is formed from polystyrene foam board insulation. A density of polystyrene insulating foam board 50 is approximately two pounds per cubic foot. Accordingly, polystyrene insulating foam board 50 is known as two-pound-density expanded polystyrene (EPS) foam insulation. Insulating foam board 50 of two-pound-density EPS is desirable due to the thermal performance and structural rigidity of two-pound-density EPS. Although two-pound-density EPS is preferred, it should be apparent to those skilled in the art that other insulating materials may be used. For example, other densities of EPS, polyurethane, and polyisocyanurate are available as rigid foam boards having effective thermal performance.

In a preferred embodiment, steel laminate backing 56 is twenty-six gauge steel laminated, or bonded, to second side 54 of insulating foam board 50. Insulating foam board 50 having twenty-six gauge steel laminate backing 56 is desirable for producing second door section 24 having effective thermal performance and structural rigidity. Although twenty-six gauge steel is preferred for steel laminate backing 56, it should be apparent to those skilled in the art that other widths of steel may be utilized. Alternatively, other metals, such as aluminum, formed into sheets may be utilized.

First and second rear support sections 70 and 74, respectively, are configured to abut steel laminate backing 56 when insulating foam board 50 is installed into cavity 76. In particular, first rear support section 70 includes a first segment 80 oriented substantially perpendicular to and contiguous with tongue surface 66. First segment 80 extends toward second longitudinal edge 64. A second segment 82, contiguous with first segment 80, is formed through the roll forming process and extends toward inner surface 48 of sheet metal layer 30. A third segment 84, contiguous with second segment 82, is formed through the roll forming process and extends toward first longitudinal edge 60. Third segment 84 has a first planar side 86 that abuts steel laminate backing 56 of insulating foam board 50.

Second rear support section 74 is similar to first rear support section 70. In particular, second rear support section 74 includes a first segment 88 oriented substantially perpendicular to and contiguous with groove surface 72. First segment 88 extends toward first longitudinal edge 60. A second segment 90, contiguous with first segment 88 extends toward inner surface 48 of sheet metal layer 30, and a third segment 92, contiguous with second segment 90 extends toward second longitudinal edge 64. Third segment 92 has a second planar side 94 that abuts steel laminate backing 56 of insulating foam board 50. First and second rear support sections 70 and 74, respectively, function to further retain insulating foam core 50 and to provide rigidity and strength to second door section 24.

In a preferred embodiment cellular foam trim boards 32 are formed from cellular polyvinylchloride (PVC) and include a wood grain finish side 96 for replicating an appearance of wood. Cellular PVC (also called PVC foam or expanded PVC) is a form of polyvinylchloride that has been extruded with a foaming agent. Cellular PVC trim boards 32 are resistant to degradation from the weather, durable, and cost effective. Although cellular PVC trim boards 32 are white, they may be readily painted by first wiping boards 32 with alcohol. Generally, cellular PVC trim boards 32 machine similarly to wood, and can be mitered.

Figure 3:
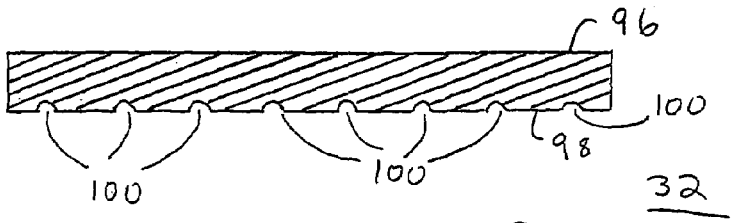
FIG. 3 shows a sectional view of a cellular foam trim board along line 3-3 in FIG. 2.

Referring to FIG. 3 in connection with FIG. 2, FIG. 3 shows a sectional view of cellular foam trim board 32 along line 3-3 in FIG. 2. Cellular PVC trim board 32 has a bonding side 98 configured to be coupled to outer surface 48 of sheet metal layer 30. Bonding side 98 includes spaced-apart channels 100 arranged lengthwise along cellular foam trim board 32. Channels 100 are formed in cellular PVC trim board 32 during the extruding process and serve as glue joints on bonding side 98.

Cellular PVC trim boards 32 are readily bonded to outer surface 46 of sheet metal layer 30 using an adhesive 102. Adhesive 102 may be conventional PVC cement. Alternatively, cellular PVC trim boards 32 may be bonded to outer surface 46 using SB-190 Everseal, manufactured by Surebond, Inc., Schaumberg, Ill. SB-190 Everseal provides effective tensile and impact strength, and securely adheres to most rigid materials.

Cellular PVC trim boards 32 are further secured to sheet metal layer 30 by stapling boards 32 to outer surface 46 using brad nails 104. Brad nails 104 advantageously curl up under sheet metal layer 30 after they have penetrated layer 30 to provide additional adherence of trim boards 32 to sheet metal layer 30 and to provide additional resistance to shear stress.

Although, cellular PVC is preferred for cellular foam trim boards 32, it should be apparent to those skilled in the art that other engineered materials may be used. Other exemplary engineered materials include polystyrene trim, polyurethane trim, polymer composite resin, and polyethylene lumber.

Figure 4:
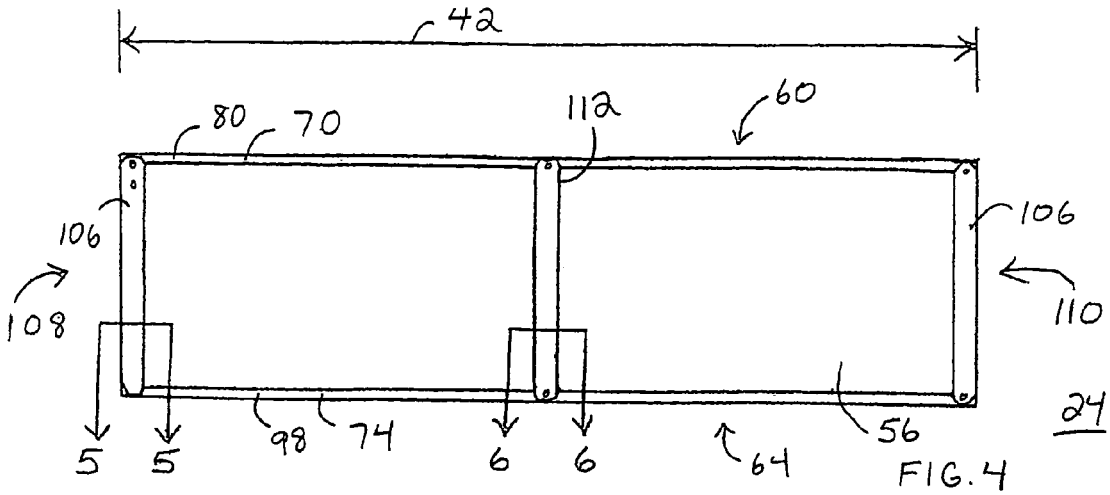
FIG. 4 shows a rear view of a door section of the carriage house replica garage door.

FIG. 4 shows a rear view of second door section 24 of the carriage house replica garage door 20 (FIG. 1). As discussed in connection with FIG. 2, the structure of second door section 24 is described for clarity of illustration. However, the following description of second door section 24 applies to first and third door sections 22 and 26 as well.

Second door section 24 further includes end support members 106 coupled to first and second lateral edges 108 and 110, respectively, of second door section 24. In particular, end support members 106 are stapled to first segment 80 of first rear support section 70 along first and second lateral edges 108 and 110. Likewise, end support members 106 are stapled to first segment 88 of second rear support section 74 along first and second lateral edges 108 and 110. End support members 106 provide structural rigidity along first and lateral edges 108 and 110, and provide a mounting surface for guide members 28 (FIG. 1).

Second door section 24 also includes a center support member 112 coupled to first and second longitudinal edges 60 and 64, respectively, sheet metal layer 30. In particular, center support member 112 is stapled to each of first segment 80 of first rear support section 70 and first segment 88 of second rear support section 74. Center support members 112 provide structural rigidity along width 42. In particular, center support member 112 functions to prevent second door section 24 from bowing along width 42 between first and second lateral edges 108 and 110, respectively.

In a preferred embodiment, when width 42 of door 20 (FIG. 1) is eight feet, second door section 24 includes one center support member 112 located approximately central to width 42. When width 42 of door 20 is ten to twelve feet, second door section 24 may include two spaced-apart center support members 112. When width 42 is greater than twelve feet, for example, sixteen or eighteen feet, second door section 24 may include three spaced-apart center support members 112.

Figure 5:
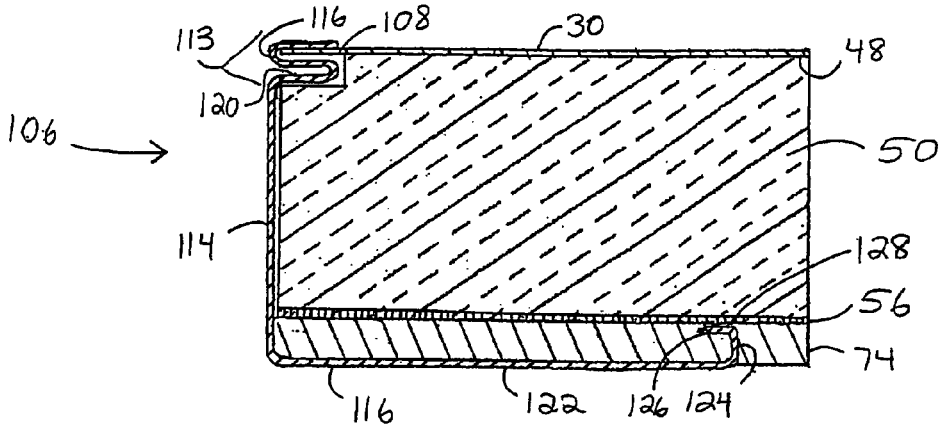
FIG. 5 shows a sectional view of an end support member along line 5-5 in FIG. 4.

FIG. 5 shows a sectional view of one of end support members 106 along line 5-5 in FIG. 4. Each of end support members 106 includes a fanfold section 113, a span section 114 contiguous with fanfold section 113, and a rear support section 116 contiguous with span section 114. End support members 106 are shaped by roll forming twenty-four to twenty-six gauge steel.

As shown in FIG. 5, fanfold section 113 has a first fold 118 configured to mesh with first lateral edge 108 of sheet metal layer 30. A second fold 120 lies against inner surface 48 of sheet metal layer 30 to provide strength. Span section 114 extends away from inner surface 48 of sheet metal layer 30 to conceal insulating foam board 50. As shown, insulating foam board 50 is notched to accommodate second fold 120.

Rear support section 116 includes a first segment 122 oriented substantially perpendicular to span section 114 and extending toward second lateral edge 110. A second segment 124, contiguous with first segment 122, is bent through the roll forming process and extends toward inner surface 48 of sheet metal layer 30. A third segment 126, contiguous with second segment 124, is bent through the roll forming process and extends toward first lateral edge 108. Third segment 126 has a planar side 128 that abuts steel laminate backing 56 of insulating foam board 50.

Figure 6:
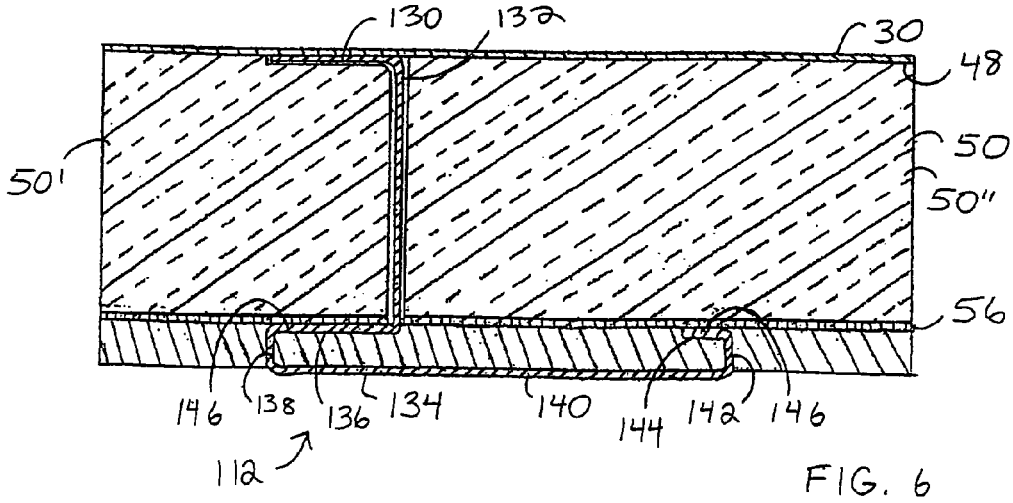
FIG. 6 shows a sectional view of a center support member along line 6-6 in FIG. 4.

FIG. 6 shows a sectional view of center support member 112 along line 6-6 in FIG. 4. Center support member 112 includes an inner support section 130, a span section 132 contiguous with inner support section 130, and a rear support section 134 contiguous with span section 132. Center support member 112 is shaped by roll forming twenty-four to twenty-six gauge steel.

As shown in FIG. 6, inner support section 130 is interposed between inner surface 48 of sheet metal layer 30 and first side 52 of insulated foam board 50. Span section 132 extends away from inner surface 48 of sheet metal layer 30. Insulated foam board 50 is split into two portions, referred to herein as first insulated foam board 50' and second insulated foam board 50", so that span section 132 may be located between first and second insulated foam boards 50' and 50", respectively.

Rear support section 134 includes a first segment 136 oriented substantially perpendicular to and contiguous with span section 132. First segment 136 extends toward first lateral edge 108 (FIG. 4) of sheet metal layer 30. A second segment 138, contiguous with first segment 136, is bent through the roll forming process to extend away from inner surface 48 of sheet metal layer 30. A third segment 140, contiguous with second segment 138, is bent through the roll forming process to extend toward second lateral edge 110 of sheet metal layer 30. A fourth segment 142, contiguous with third segment 140, is bent through the roll forming process to extend toward inner surface 48 of sheet metal layer 30. A fifth segment 144, contiguous with fourth segment 142, is bent through the roll forming process to extend back toward first lateral edge 108 of sheet metal layer 30. Each of first and fifth segments 136 and 144, respectively, have a planar side 146 that abuts steel laminate backing 56 of insulating foam board 50.

In addition, to preventing bowing of second door section 24 along width 42, center support member 112 also provides structural rigidity throughout a thickness of door section 24. This structural rigidity is provided by the cooperative relationship between inner support section 130, span section 132, and rear support section 134 and by roll forming center support member 112 from one piece of steel.

Figure 7:
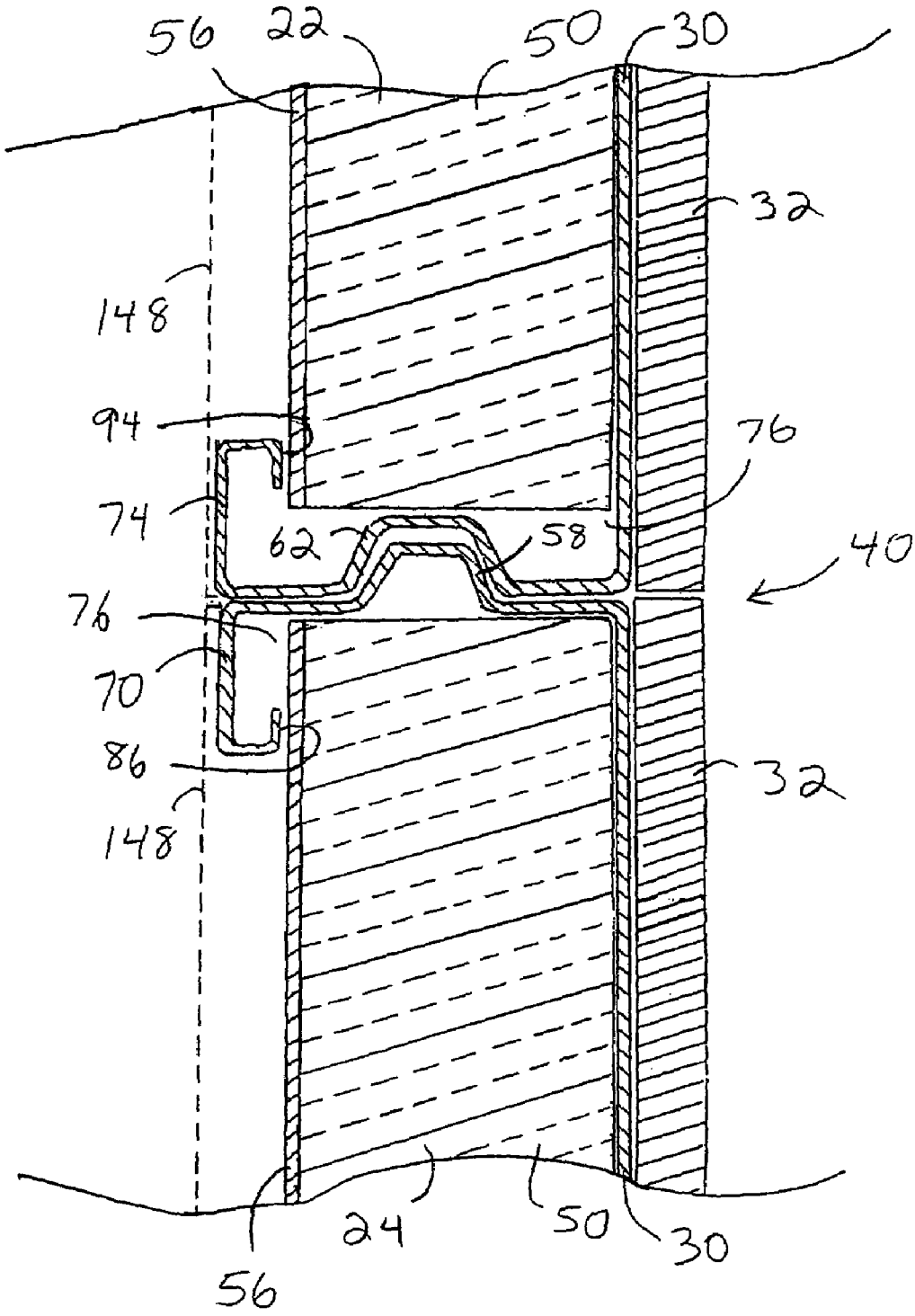
FIG. 7 shows a partial side view of a section joint between two door sections of the carriage house replica garage door of FIG. 1.

FIG. 7 shows a partial side view of one of section joints 40 between two door sections of the carriage house replica garage door 20 (FIG. 1). For example, section joint 40 is formed between first door section 22 and second door section 24. As shown, tongue portion 58 of second door section 24 mates with groove portion 62 of first door section 22. Although not shown, groove portion 62 of second door section 24 mates with tongue portion 58 of third door section 26 in the same manner. Cellular foam trim boards 32 are installed on the outer face of first and second door sections 22 and 24, respectively.

FIG. 7 also shows foam insulating layer 50 with steel laminate backing 56 positioned in cavity 76. Second planar side 94 of second rear support section 74 abuts steel laminate backing 56 located in first door section 22. Likewise, first planar side 86 of first rear support section 70 abuts steel laminate backing 56 located in second door section 24. Dashed lines 148 represent the relationship between the location of end support members 106 (FIG. 4) and center support members 112 (FIG. 4) relative to first rear support section 70 of sheet metal layer 30 of second door section 24. Similarly, dashed lines 148 represent the relationship between the location of end support members 106 and center support members 112 relative to second rear support section 74 of sheet metal layer 30 of first door section 22.

Figure 8:
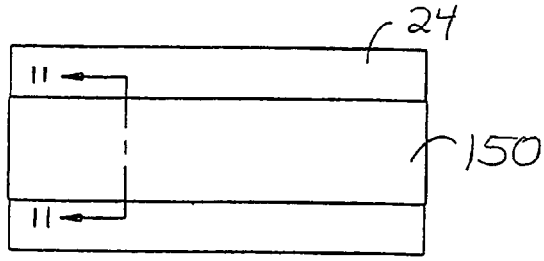
FIG. 8 shows a front view of a door section of the carriage house replica door of FIG. 1 including a trim board system in accordance with an alternative embodiment of the present invention.

FIG. 8 shows a front view of door section 24 of carriage house replica door 20 (FIG. 1) including a trim board system 150 in accordance with an alternative embodiment of the present invention. Temperature extremes, direct sunlight, and color can have an undesirable impact on the ability of a material to be used as a trim board for carriage house replica door 20. For example, steel doors painted a dark color can reach temperatures in excess of two hundred degrees when the door is in direct sunlight and when the air temperature exceeds one hundred degrees. Under these extreme conditions, some materials may have expansion and contraction problems, such as buckling, cupping, splitting, bowing, and so forth, that render the materials unusable.

Accordingly, it will become apparent in the ensuing discussion that trim board system 150 can be advantageously utilized on the twenty-eight inch door sections 22, 24, and 26 (FIG. 1) of carriage house replica door 20 in lieu of, or as an adjunct to cellular foam trim boards 32 (FIG. 1) in locations subject to temperature extremes, direct sunlight, and/or when carriage house replica door is to be a dark color. In addition, although trim board system 150 is described in connection with carriage house replica door 20, described in detail above, trim board system 150 may be alternatively utilized in connection with steel or aluminum garage doors having an opened faced structure, other sandwich-style structures and more or less than the three twenty-eight inch door sections, described above.

Figure 9:
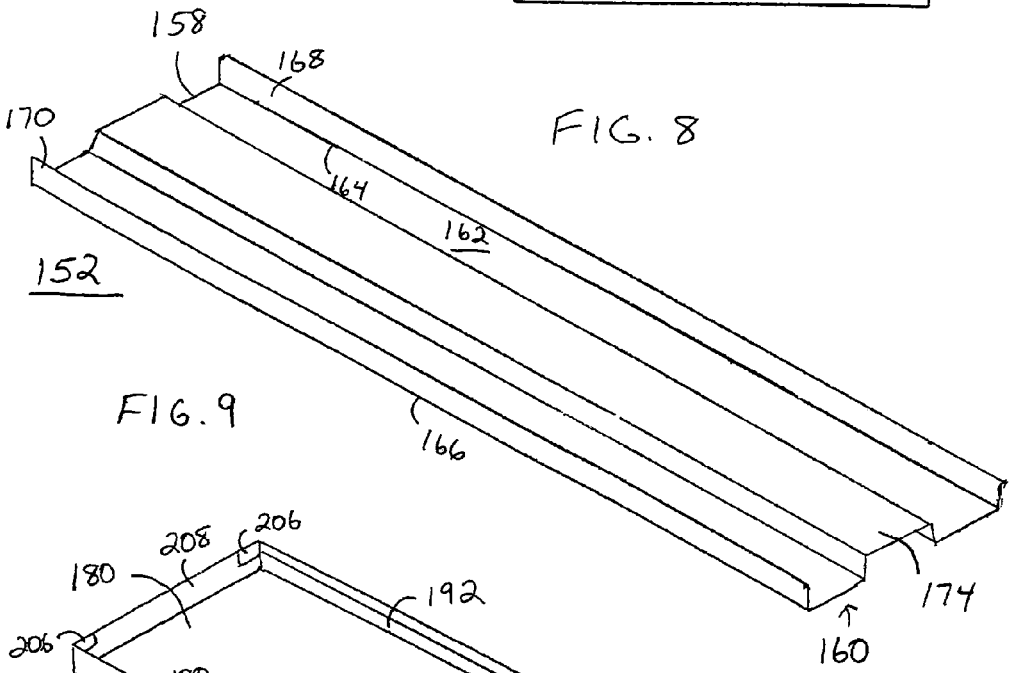
FIG. 9 shows a perspective view of a first channel section of the trim board system of FIG. 8.
Figure 10:
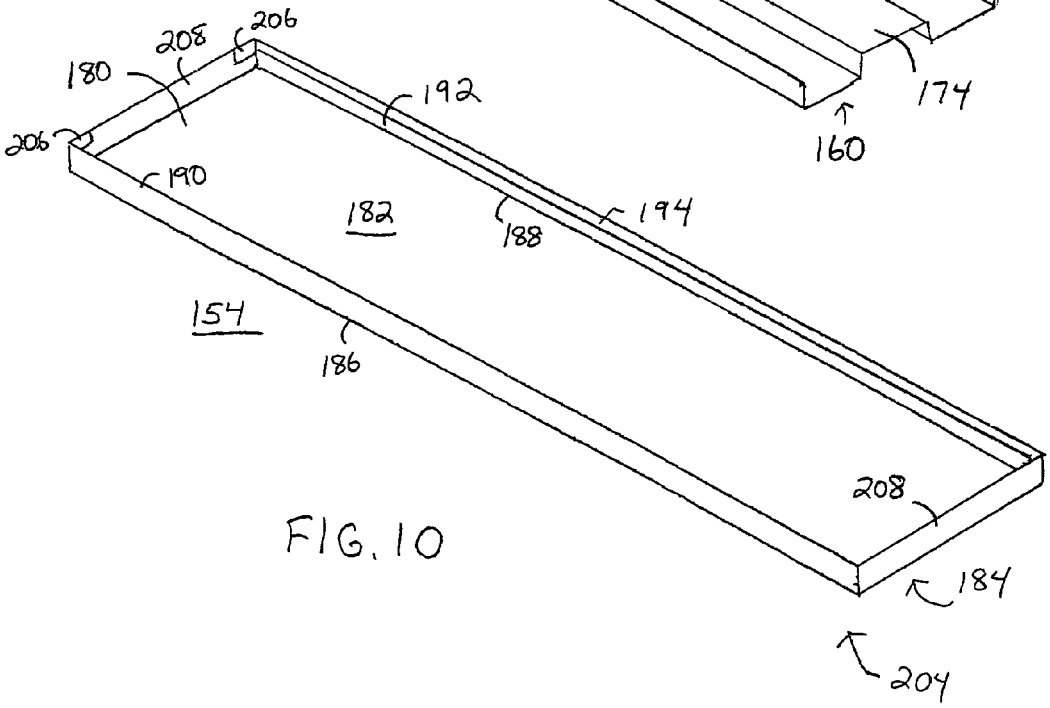
FIG. 10 shows a perspective view of a second channel section of the trim board system of FIG. 8.
Figure 11:
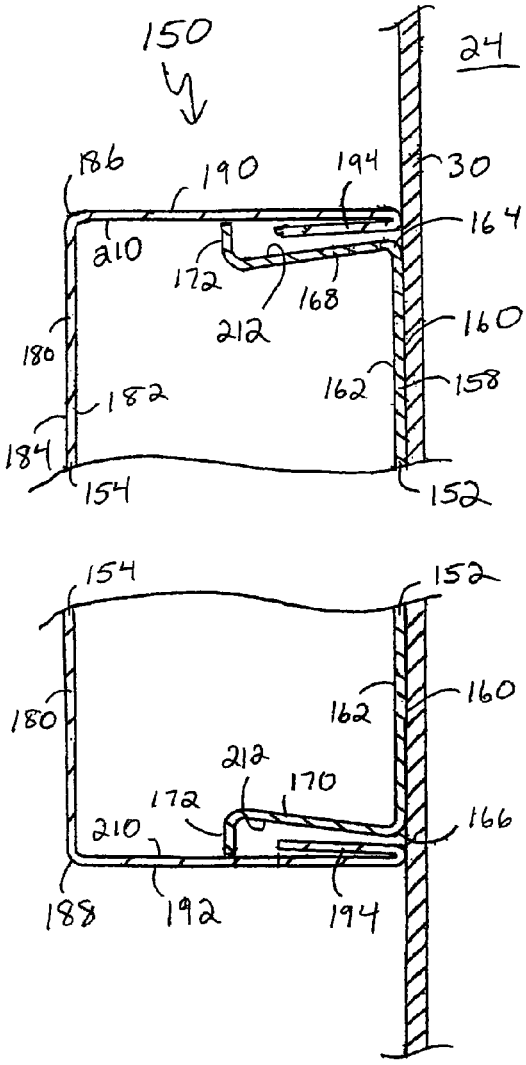
FIG. 11 shows a partial sectional view of the door section along line 11-11 of FIG. 8.

Referring to FIGS. 9-11, FIG. 9 shows a perspective view of a first channel section 152 of trim board system 150. FIG. 10 shows a perspective view of a second channel section 154 of trim board system 150, and FIG. 11 shows a partial sectional view of door section 24 along line 11-11 of FIG. 8. Trim board system 150 includes first channel section 152 and second channel section 154 interlocking with first channel section 152. In a preferred embodiment first and second channel sections 152 and 154, respectively, are manufactured from steel sheet metal that is formed into channel sections 152 and 154 by rollforming or bending the steel sheet metal.

First channel section 152 includes a first surface portion 158 having a first side 160 and a second side 162. First side 160 is configured for attachment to sheet metal layer 30 of door section 24. In a preferred embodiment, first channel section 152 is coupled to sheet metal layer 30 utilizing a combination of structural adhesive and mechanical fasteners, such as rivets, screws, staples, and the like.

First surface portion 158 includes first and second substantially parallel longitudinal edges 164 and 166, respectively. A first lip 168 is formed along first edge 164 of first surface portion 158. Similarly, a second lip 170 is formed along second edge 166 of first surface portion 158. First and second lips 168 and 170, respectively, extend from second side 162 of first surface portion 158. Each of first and second lips 168 and 170, respectively, of first channel section 152 includes an outwardly flanged longitudinal edge 172, the purpose of which will be discussed below.

Brace means, in the form of a longitudinally extending rib 174, is juxtaposed between first and second channel sections 152 and 154, respectively. In an exemplary embodiment, rib 174 projects from first surface portion 158, and is formed by rollforming or bending the sheet metal of first channel section 152. Alternatively, rib 174 may be a separate component that is coupled by structural adhesive and/or mechanical fasteners to either of first or second channel sections 152 and 154.

Second channel section 154 includes a second surface portion 180 having a third side 182 and a fourth side 184. Second surface portion 180 is rotary embossed with a wood grain pattern for replicating an appearance of wood. Second surface portion 180 includes third and fourth substantially parallel longitudinal edges 186 and 188, respectively. A third lip 190 is formed along third edge 186 of second surface portion 180. Similarly, a fourth lip 192 is formed along fourth edge 188 of second surface portion 180. Third and fourth lips 190 and 192, respectively, extend from third side 182 of second surface portion 180. In addition, each of third and fourth lips 190 and 192 of second channel section 154 includes a folded longitudinal extension portion 194 formed by bending the outer edge of each of third and fourth lips 190 and 192 inwardly.

Second channel section 154 further includes a first closed end 202 and a second closed end 204 at opposing ends of second surface portion 180. During manufacturing, second channel section 154 is notched to form tabs 206, of which only two can be seen. Second surface portion 180 is then folded to create folded ends 208, and tabs 206 are overlapped onto folded ends 208 of second surface portion 180. Tabs 206 are then secured onto folded ends 208 by spot-welding, gluing, riveting, and so forth to form a solid structure. First and second closed ends 202 and 204 may be further sealed at each inside corner with a caulk or siliconized sealant to prevent the entry of moisture.

To assemble, first side 160 of first surface portion 158 of first channel section 152 is coupled to sheet metal 30 of door section 24. Second channel section 154 is then mated, or engaged, with first channel section 152. In a preferred embodiment, inner sides 210 of third and fourth lips 190 and 192, respectively, engage with corresponding outer sides 212 of first and second lips 168 and 170, respectively. More specifically, when second channel section 154 is compressed onto first channel section 152, folded extension portions 194 interlock with corresponding flanged edges 172 to retain second channel section 154 onto first channel section 152 without the need for additional structural adhesive and/or mechanical fasteners. The interconnection of folded longitudinal extension portions 164 with flanged edges 172 forms a secure locking mechanism and enhances the structural integrity of trim board system 150.

In addition, the two-piece snap together design allows for damaged components to be readily replaced. The two-piece snap together design also enables any fasteners to be concealed, and reduces the overall weight of trim board system 150 over prior art natural and man-made trim boards. Longitudinally extending rib 174 is lightweight, and provides bracing between first and second channel sections 152 and 154 to help resist the denting or crushing that might occur due to compressive force. Yet another advantage of trim board system 150 is that it is cost effective to manufacture. More specifically, trim board system 150 is a design that is readily placed in a production line environment with robotics and self-piercing rivets, thus making production time faster than current production times.

Figure 12:
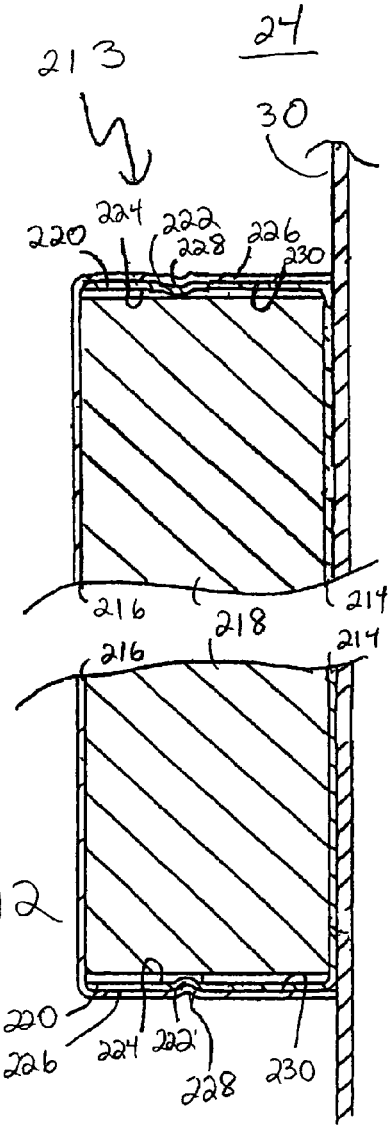
FIG. 12 shows a partial sectional view of the door section in which a trim board system in accordance with an alternative embodiment of the present invention is employed.

FIG. 12 shows a partial sectional view of door section 24 in which a trim board system 213 in accordance with an alternative embodiment of the present invention is employed. Trim board system 213 is similar to trim board system 150 in that it includes a first channel section 214 and a second channel section 216. An optional insulating foam board 218 is juxtaposed between first and second channel sections 214 and 216, respectively. Insulating foam board 218 may be expanded polystyrene foam (EPS) with a density of 0.7 or greater, and may be bonded to either of first and second channel sections 214 and 216.

First channel section 214 includes first lips 220, each having a first longitudinally extending rib 222 projecting from a first inner side 224 of each of first lips 220. Similarly, second channel section 216 includes second lips 226, each having a second longitudinally extending rib 228 projecting from a second inner side 230 of each of second lips 226.

To assemble, first channel section 214 is coupled to sheet metal 30 of door section 24, as discussed in connection with first channel section 152 (FIG. 11). Insulating foam board 218 is then positioned within first channel section 214. Insulating foam board 214 may optionally be adhered to first channel section 214 using a structural adhesive. Second channel section 216 is then mated, or engaged, with first channel section 214, such that second lips 226 of second channel section 216 cover first lips 220 of first channel section 214. In addition, second ribs 228, projecting from second lips 226, engage first ribs 222, projecting from first lips 220. Thus, first ribs 222 and 228 effectively interlock to retain second channel section 216 onto first channel section 214 without the need for additional structural adhesive and/or mechanical fasteners. Accordingly, a strong steel trim board is formed that replicates the appearance of wood but is but is impervious to the problems encountered with temperature extremes, direct sunlight, and dark colors. Insulating foam board, juxtaposed between first and second channel sections 214 and 216, is lightweight, while at the same time, fills the cavity between first and second channel sections 214 and 216, respectively, to help reduce the denting or crushing that might occur due to compressive force.

Figure 13:
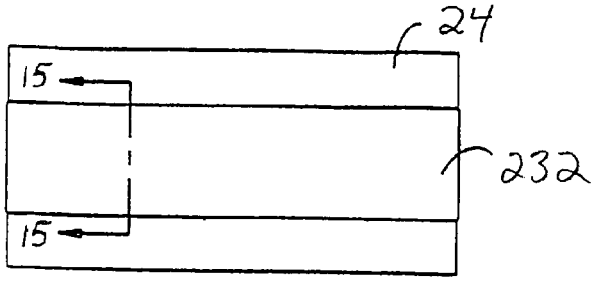
FIG. 13 shows front view of a door section of the carriage house replica door of FIG. 1 including a trim board assembly in accordance with another alternative embodiment of the present invention.

FIG. 13 shows a front view of door section 24 of carriage house replica door 20 (FIG. 1) including a trim board assembly 232 in accordance with another alternative embodiment of the present invention. Like the situation discussed in connection with FIG. 8, temperature extremes, direct sunlight, and color can have an undesirable impact on the ability of a material to be used as a trim board for carriage house replica door 20.

Like trim board system 150 (FIG. 8), it will become apparent in the ensuing discussion that trim board assembly 232 can be advantageously utilized on the twenty-eight inch door sections 22, 24, and 26 (FIG. 1) of carriage house replica door 20 in lieu of, or as an adjunct to cellular foam trim boards 32 (FIG. 1) in locations subject to extreme environmental conditions. However, trim board assembly 232 is of a simpler construct than trim board system 150 which lessens the cost of manufacturing.

Although trim board assembly 232 is described in connection with carriage house replica door 20, discussed in detail above, trim board assembly 232 may be alternatively utilized in connection with steel or aluminum garage doors having an opened faced structure, other sandwich-style structures and more or less than the three twenty-eight inch door sections, described above.

Figure 14:
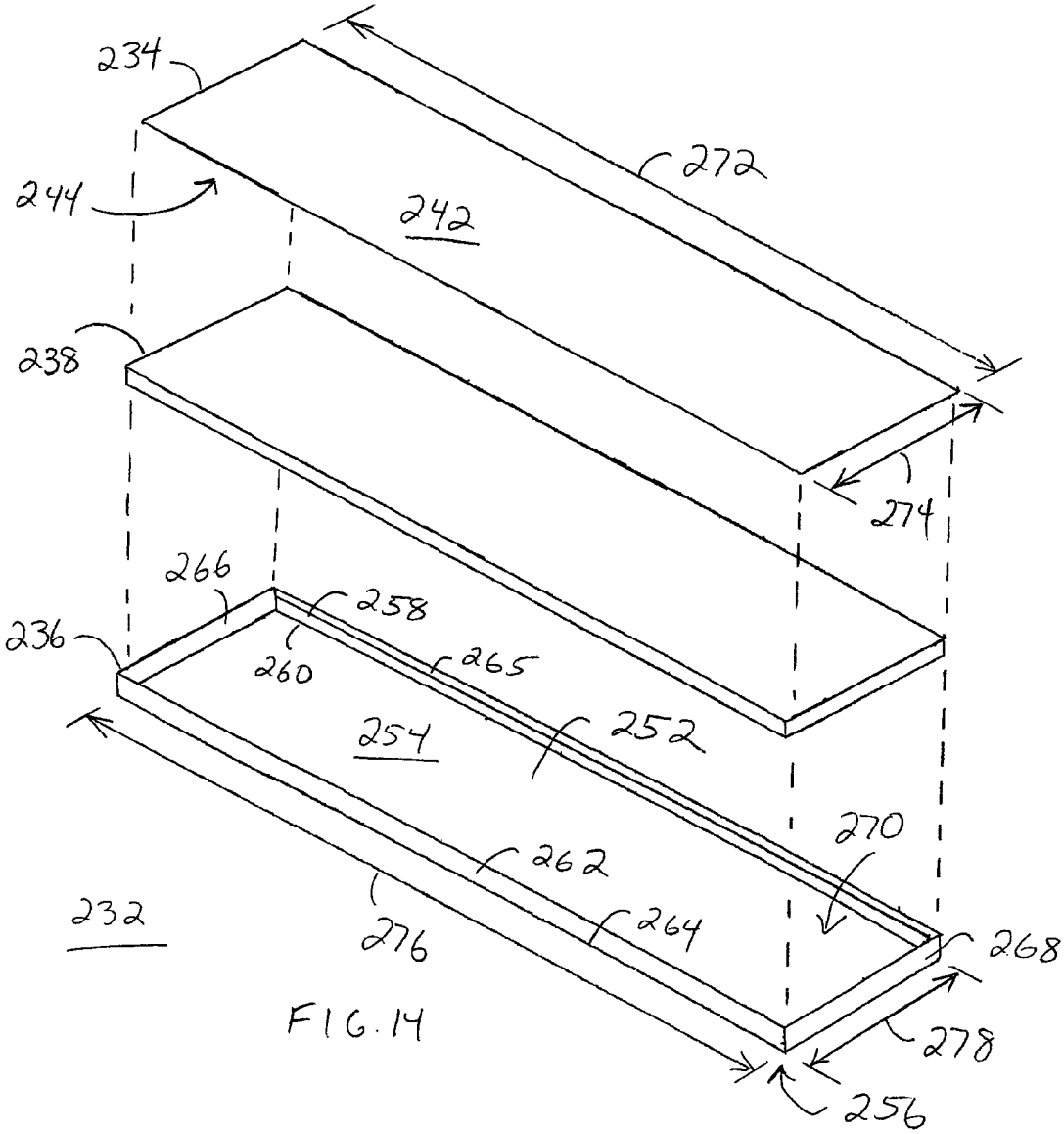
FIG. 14 shows an exploded perspective view of the trim board assembly of FIG. 13.
Figure 15:
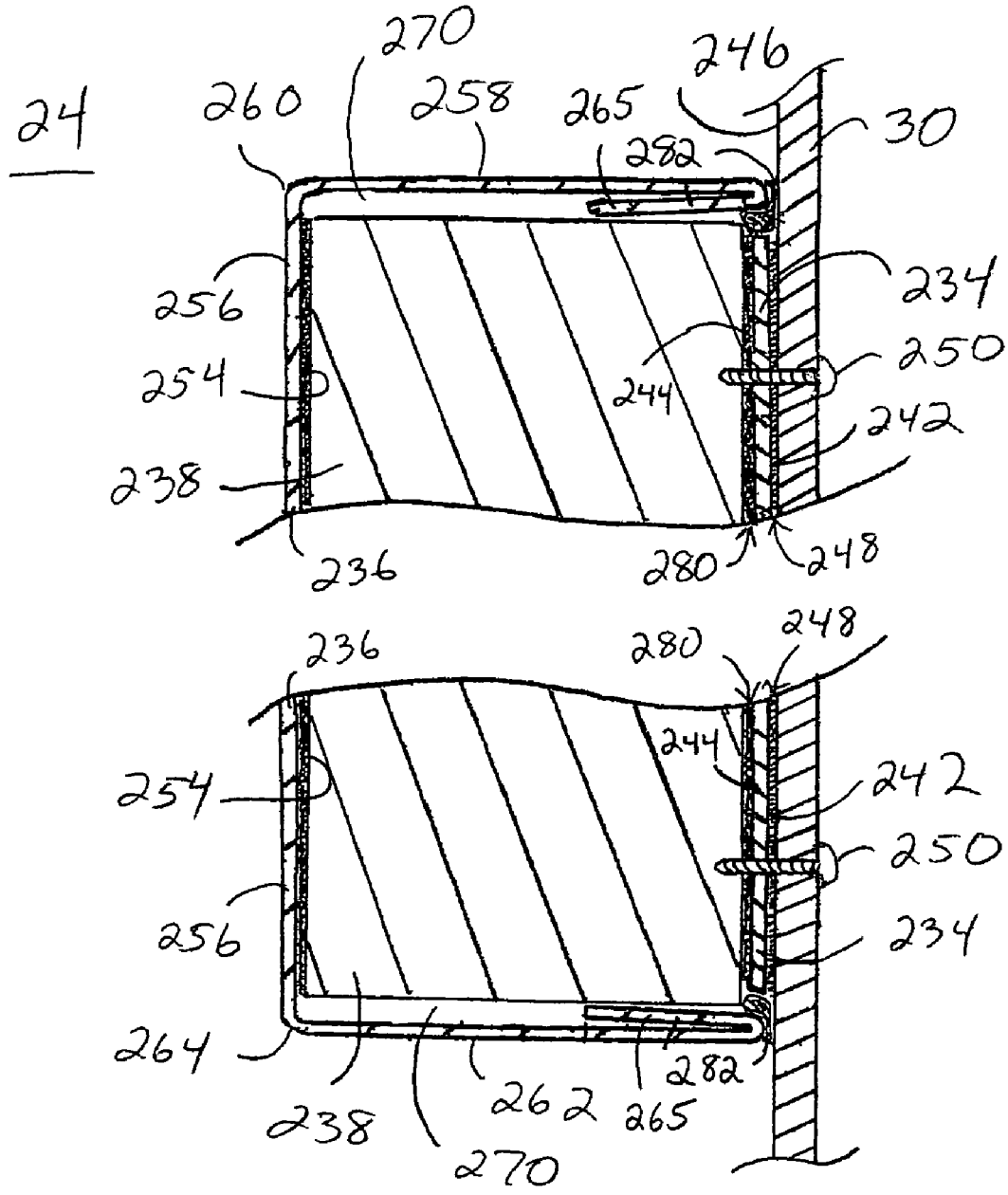
FIG. 15 shows a partial sectional view of the door section along line 15-15 of FIG. 13.

Referring to FIGS. 14-15, FIG. 14 shows an exploded perspective view of trim board assembly 232, and FIG. 15 shows a partial sectional view of door section 24 along section line 15-15 of FIG. 13. Trim board assembly 232 includes a backing 234 and a channel section 236 installed over backing 234. Brace means, in the form of an insulating foam board 238, is juxtaposed between backing 234 and channel section 236. In a preferred embodiment, backing 234 and channel section 236 are manufactured from steel sheet metal. As shown, backing 234 is substantially flat. In contrast, channel section 236 may be manufactured in its desired shape by rollforming or bending the steel sheet metal.

Backing 234 includes a first side 242 and a second side 244. First side 242 is configured for attachment to a face 246 of sheet metal layer 30 of door section 24 (FIG. 13). In a preferred embodiment backing 234 is coupled to sheet metal layer 30 utilizing a combination of structural adhesive 248, such as an epoxy-based cement, and mechanical fasteners, such as self-taping sheet metal screws 250, rivets, staples, and the like.

Channel section 236 includes a surface portion 252 having an interior side 254 and an exterior side 256. Surface portion 252 may optionally be rotary embossed for replicating an appearance of wood. A first leg 258 is formed along a first longitudinal edge 260 of surface portion 252. Similarly, a second leg 262 is formed along a second longitudinal edge 264 of surface portion 252. First and second legs 258 and 262, respectively, extend from interior side 254 of surface portion 252. First and second legs 258 and 262, respectively, may be approximately 0.375 to 0.75 inches in height to create a C-channel type of steel board.

First and second legs 258 and 262, respectively, include hem edges 265. Hem edges 265 are created by rollforming the sheet metal edge to fold it directly over itself, leaving a small radius at the fold. Hem edges 265 enhance the strength of channel section 236, improve the appearance of channel section 236, and eliminate sharp edges in areas where metal could come into contact with human skin, such as during installation.

Channel section 236 further includes a first closed end 266 and a second closed end 268 at opposing ends of surface portion 252. During manufacturing, slots may be cut at the opposing ends of surface portion 252. Surface portion 252 may simply be folded over at the same height as first and second legs 258 and 262, respectively, to create first and second closed ends 266 and 268, respectively. Alternatively, channel section 236 may be manufactured to include tabs, such as tabs 206 (FIG. 10) described in connection with second channel section 154 (FIG. 10) of trim board system 150 (FIG. 8). First and second closed ends 266 and 268, respectively, may also include hem edges, such as hem edges 265 discussed above.

Together, first and second legs 258 and 262 and first and second closed ends 266 and 268 define the perimeter of an interior cavity 270 of channel section 236 into which insulating foam board 238 is positioned.

Insulating foam board 238 is of a length and a width that enables foam board 238 to reside in interior cavity 270. Similarly, a thickness of insulating foam board 238 is approximately equivalent to the depth of interior cavity 270 so that channel section 236 is largely filled when foam board 238 is installed in interior cavity 270.

In an exemplary embodiment, foam board 238 is expanded polystyrene (EPS) foam. EPS foam is lightweight, yet structurally strong, exhibits high thermal efficiency and insulation properties, and is resistant to moisture. Accordingly, trim board assembly 232 including foam board 238 of EPS foam is lightweight, resistant to crushing, and cost effective to manufacture.

Those skilled in the art will recognize that alternative materials may be utilized for insulating foam board 238 rather than EPS foam. In addition, a trim board assembly need not include a foam board, but may instead include a metal, longitudinally disposed, rib member juxtaposed between backing 234 and channel section 236 in place of foam 238 to serve as brace means.

Backing 234 exhibits a length 272 and a width 274. Similarly, channel section 236 exhibits a length 276 and a width 278. In an exemplary embodiment, length 272 of backing 234 may be less than length 276 of channel section 236. Likewise, width 274 of backing 234 may be less than width 278 of channel section 236. As will be discussed below, once constructed, this difference between lengths and widths enables the construction of trim board assembly 232 such that physical contact between backing 234 and channel section 236 is inhibited or prevented at an attachment location of backing 234 and channel section 236.

Inhibiting or preventing metal to metal contact between backing 234 and channel section 236 is particularly desirable when backing 234 and channel section 236 are fabricated from dissimilar metals. Preventing contact between dissimilar metals prevents galvanic corrosion which will eventually cause the metals to disintegrate. Even when the metals are of the same or compatible materials, preventing contact between the metals can be advantageous in that one layer of metal cannot rub or wear against the other. Should the two metal surfaces rub against each other enough to scratch off their protective coating, such as paint, bare metal can become exposed to the corrosive effects of the environment. Furthermore, by maintaining space between backing 234 and channel section 236, a better moisture resistant seal can be made with caulk (discussed below) so as to limit the deleterious effects of crevice corrosion in which dirt accumulates in the joints and seams of metal fixtures, and moisture collects in this accumulated dirt.

Manufacture of trim board assembly 232 entails coating both sides of insulating foam board 238 with a hot melt adhesive 280. Foam board 238 is inserted into cavity 270 and second side 244 (i.e., the inner side) of backing 234 is then applied to foam board 238. Trim board assembly 232 is then put through a laminator that provides heat sufficient to soften adhesive 280 so that channel section 236 and backing 234 adhere to foam board 238. Accordingly, adhesive 280 and foam board 238 function as means for attaching channel section 236 to backing 234 while inhibiting or preventing physical contact between backing 234 and channel section 236 at the attachment location (i.e., the areas of adhesion utilizing adhesive 280).

In a preferred embodiment, adhesive 280 is a hot melt polyurethane adhesive. Hot melt adhesives are typically solvent-free thermoplastics that melt or drop in viscosity above 180° F., and then rapidly set upon cooling. Conventional hot melt adhesives can be repeatedly softened by heat and hardened or set by cooling, which allows parts to be removed, repositioned, or replaced during assembly. In contrast, polyurethane (PUR) reactives or hot melt polyurethane adhesives are applied like conventional hot melt adhesives, but the PUR adhesives reacts with moisture to form crosslinked bonds that cannot be remelted. Accordingly, PUR reactives or hot melt polyurethane adhesives provide excellent flexibility, impact resistance, heat resistance, and durability. Although hot melt polyurethane adhesive is preferred herein for adhesive 280, it should be understood that alternative hot melt, two-part catalyst, or thermoset adhesives may be utilized to adhere insulating foam board 238 with backing 234 and channel section 236.

After trim board assembly 232 is manufactured, each trim board assembly 232 is mechanically fastened to face 246 of sheet metal layer 30 of any of door sections 22, 24, and 26 (FIG. 1) that make up carriage house replica garage door 20 (FIG. 1), using sheet metal screws 250, and bonded, using structural adhesive 248. Once coupled, caulk 282 is applied at the junction of trim board assembly 232 with sheet metal layer 30 to prevent moisture from penetrating the underside of trim board assembly 232. Thus, various patterns for carriage house replica door can be created using a number of trim board assemblies 232.

The design of trim board assembly 232 yields a sandwich structure steel board that is lightweight, moisture resistant, durable, and not compromised under harsh environmental conditions. The inclusion of insulating foam board 238 also enables trim board assembly 232 to resist the denting or crushing that might occur due to compressive force. In addition, trim board assembly 232 is cost effective to manufacture. That is, it can be readily placed in a production line environment thus making production time faster than current production times.

Figure 16:
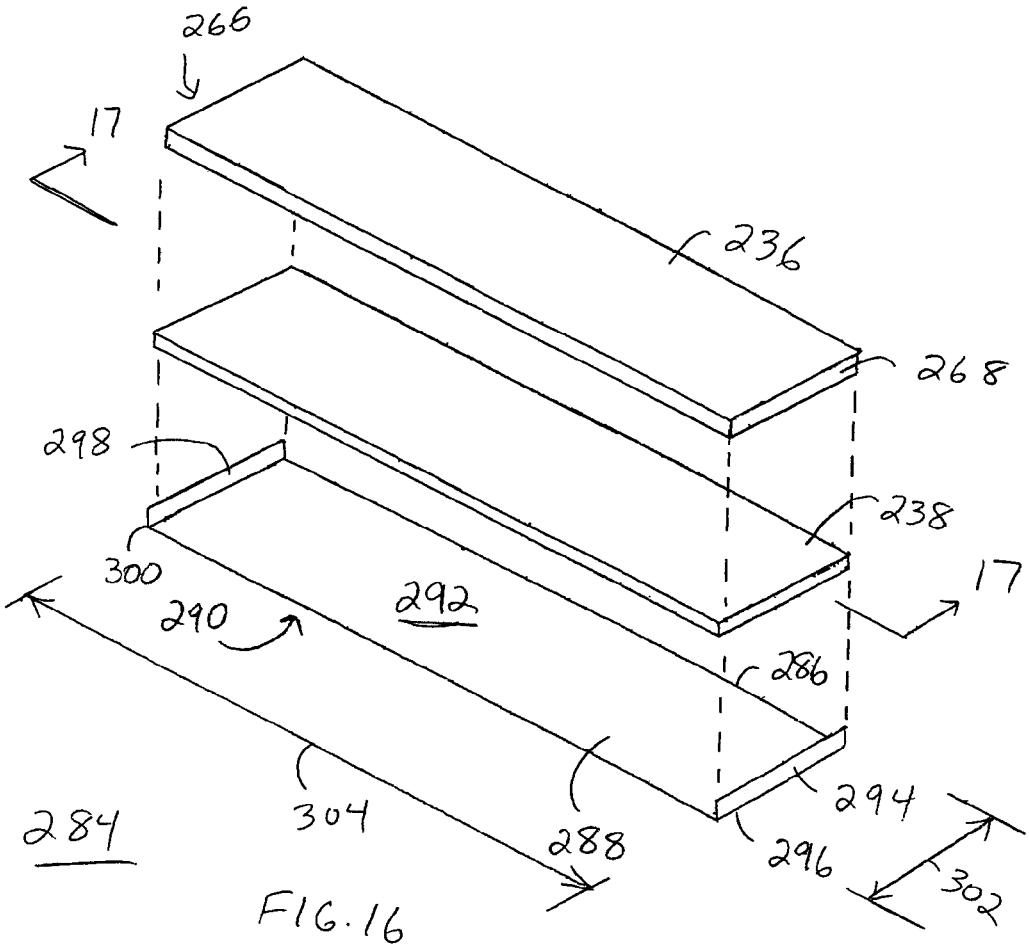
FIG. 16 shows an exploded perspective view of a trim board assembly in accordance with another alternative embodiment of the present invention.
Figure 17:
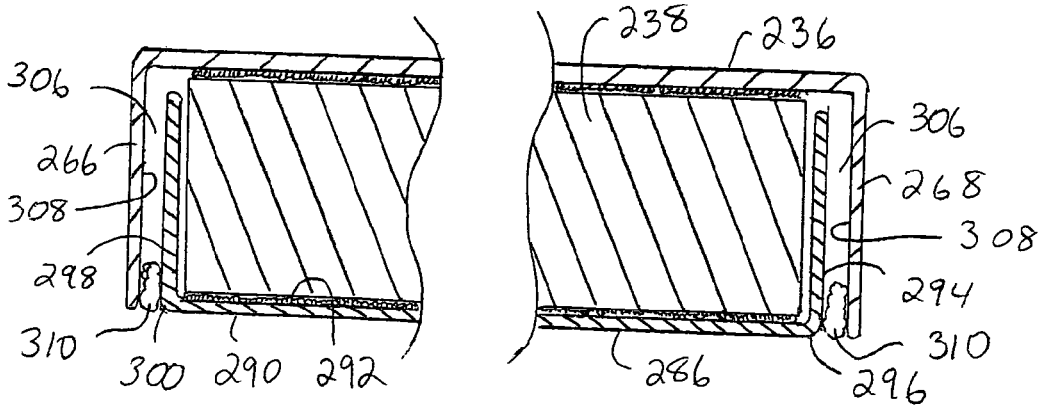
FIG. 17 shows a partial sectional view of the trim board assembly along line 17-17 of FIG. 16.

Referring now to FIGS. 16-17, FIG. 16 shows an exploded perspective view of a trim board assembly 284 in accordance with another alternative embodiment of the present invention, and FIG. 17 shows a partial sectional view of the trim board assembly 284 in an assembled form along line 17-17 of FIG. 16. Trim board assembly 284 includes channel section 236 and insulating foam board 238. Accordingly, the description of channel section 236 and insulating foam board 238 need not be repeated in connection with trim board assembly 284.

However, trim board assembly 284 includes a support backing 286 as a replacement for backing 234 (FIG. 14) of trim board assembly 232 (FIG. 14). Support backing 286 includes a backing surface 288 having a first side 290 and a second side 292, with first side 290 being configured for attachment to face 246 (FIG. 15) of sheet metal layer 30 (FIG. 15) of, for example, door section 24 (FIG. 15).

A first support 294 is formed along a first edge 296 at an end of backing surface 288, and extends from second side 292 of backing surface 288. Similarly, a second support 298 is formed along a second edge 300 at an opposing end of backing surface 288, and extends from second side 292 of backing surface 288. Thus, first and second supports 294 and 298, respectively, are positioned across a width 302 of backing surface 288.

Like trim board assembly 232, a length 304 and width 302 of support backing 288 is less than length 276 (FIG. 14) and width 278 (FIG. 14) of channel section 236. Accordingly, when trim board assembly 284 is constructed, first and second supports 294 and 298, respectively, of support backing 286 reside in cavity 270 of channel section 236. Thus, first and second supports 294 and 298 provide additional rigidity to trim board assembly 284 and help to guide support backing 288 properly into place over insulating foam board 238 during assembly.

Since length 304 of support backing 288 is less than length 276 of channel section 236, a gap 306 is formed between each of first and second supports 294 and 298, respectively, and corresponding interior walls 308 of channel section 236. In a preferred embodiment, a caulk bead 310 may fill gap 306 to maintain separation between support backing 288 and channel section 236. In addition, since caulk bead 310 is applied between the metal surfaces of channel section 236 and support backing 288, a more effective moisture resistant seal is obtained. Of course, it should be apparent to those skilled in the art that the longitudinal edges of support backing 288 may also include supports resembling first and second supports 294 and 298 to further increase the stiffness and moisture sealing properties of trim board assembly 284.

In summary, the present invention teaches of a door section for a carriage house replica garage door. The carriage house replica garage door, fabricated from three door sections and trimmed with sandwich-structure steel trim board assemblies, form an aesthetically pleasing and cost effective replica of a wood sectional carriage house garage door. Furthermore, the sheet metal trim board assemblies are lightweight, durable, impervious to the problems encountered with temperature extremes, direct sunlight, and dark colors, and are not subject to insect damage. The trim board assemblies are moisture resistant, subject to little or no rusting, and are resistant to crushing and denting. As such, the carriage house replica garage door, having a design created through the use of steel trim board assemblies, requires little maintenance.

Although the preferred embodiments of the invention have been illustrated and described in detail, it will be readily apparent to those skilled in the art that various modifications may be made therein without departing from the spirit of the invention or from the scope of the appended claims. For example, the door sections may be adapted for use in a four section carriage house replica garage door, rather than the three section carriage house garage door described herein.

What is claimed is:

1. A trim board assembly for a door section of a carriage house replica garage door comprising:

a garage door section having an outer face; and a trim board assembly, comprising:

a backing attached to said face of said door section;

a channel section installed over said backing;

brace means juxtaposed between said backing and said channel section; and means for attaching said channel section to said backing that inhibits physical contact between said backing and said channel section at an attachment location, wherein said attaching means is an adhesive for adhering said brace means to each of an interior surface of said channel section and an inner side of said backing.

2. A trim board assembly as claimed in claim 1 wherein said backing is substantially flat steel.

3. A trim board assembly as claimed in claim 1 wherein said backing comprises:

a backing surface having a first side and a second side, said first side configured for attachment to said face of said door section;

a first support formed along a first edge of said backing surface; and a second support formed along a second edge of said backing surface, said first and second supports extending from said second side of said backing surface.

4. A trim board assembly as claimed in claim 3 wherein said first and second supports are positioned across a width of said backing surface.

5. A trim board assembly as claimed in claim 3 wherein said channel section includes an interior cavity and said first and second supports of said backing reside in said interior cavity.

6. A trim board assembly as claimed in claim 5 wherein a dimension of said backing is less than a corresponding dimension of said channel section to form a gap between each of said first and second supports and corresponding interior walls of said channel section.

7. A trim board assembly as claimed in claim 6 further comprising a caulk bead filling said gap to maintain separation between said backing and said channel section.

8. A trim board assembly as claimed in claim 1 wherein said channel section comprises:

a surface portion having an interior side and an exterior side;

a first leg formed along a first longitudinal edge of said surface portion; and a second leg formed along a second longitudinal edge of said surface portion, said first and second legs extending from said interior side of said surface portion.

9. A trim board assembly as claimed in claim 8 wherein each of said first and second legs of said channel section comprises a hem edge.

10. A trim board assembly as claimed in claim 1 wherein said brace means comprises an insulting foam board.

11. A trim board assembly as claimed in claim 1 wherein said attaching means prevents physical contact between said backing and said channel section at an attachment location.

12. A trim board assembly as claimed in claim 1 wherein each of said backing and said channel section is formed from sheet metal.

13. A door section for a carriage house replica garage door comprising a sheet metal layer having an outer face;

a trim board assembly including:

a backing attached to said face of said door section;

a channel section installed over said backing, each of said backing and said channel section being formed from sheet metal;

brace means juxtaposed between said backing and said channel section; and means for attaching said channel section to said backing that inhibits physical contact between said backing and said channel section at an attachment location, wherein said attaching means is an adhesive for adhering said brace means to each of an interior surface of said channel section and an inner side of said backing.

14. A door section as claimed in claim 13 wherein said backing of said trim board assembly comprises:

a backing surface having a first side and a second side, said first side configured for attachment to said face of said door section;

a first support formed along a first edge of said backing surface; and a second support formed along a second edge of said backing surface, said first and second supports extending from said second side of said backing surface, and said first and second support residing in an interior cavity of said channel section.

15. A door section as claimed in claim 13 wherein said brace means comprises an insulating foam board.

16. A trim board assembly for a door section of a carriage house replica garage door comprising:

a door section having an outer face;

a trim board assembly including:

a backing attached to said face of said door section;

a channel section installed over said backing, said channel section including a surface portion having an interior side and an exterior side, a first leg formed along a first longitudinal edge of said surface portion, and a second leg formed along a second longitudinal edge of said surface portion, said first and second legs extending from said interior side of said surface portion;

brace means juxtaposed between said backing and said channel section; and adhesive adhering said brace means to each of an interior surface of said channel section and an inner side of said backing that inhibits physical contact between said backing and said channel section at an attachment location.

17. A trim board assembly as claimed in claim 16 wherein said brace means comprises an insulating foam board.

18. A trim board assembly for a door section of a garage door comprising:

a door section having an outer face;

a trim board assembly including:

a backing attached to said face of said door section, wherein said backing has a first longitudinal edge and a second longitudinal edge;

a channel section installed over said backing, wherein said channel section includes a first leg adjacent to said first longitudinal edge and a second leg adjacent to said second longitudinal edge, wherein said first and second legs are substantially flat, and wherein a dimension of said backing is less than a corresponding dimension of said channel section to form a gap between each of said first and second longitudinal edges and corresponding said first and second legs of said channel section; and means for attaching said channel section to said backing that inhibits physical contact between said first and second longitudinal edges of said backing and corresponding said first and second legs of said channel section, wherein said attaching means is an adhesive.

* * * * *